US010730307B2

(12) United States Patent
Koike et al.

(10) Patent No.: US 10,730,307 B2
(45) Date of Patent: Aug. 4, 2020

(54) METHOD FOR MANUFACTURING LIQUID CONTAINER, AND LIQUID CONTAINER

(71) Applicant: SEIKO EPSON CORPORATION, Tokyo (JP)

(72) Inventors: Yasunori Koike, Matsumoto (JP); Takashi Koase, Shiojiri (JP); Satsuki Hayashi, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/883,765

(22) Filed: Jan. 30, 2018

(65) Prior Publication Data

US 2018/0215160 A1 Aug. 2, 2018

(30) Foreign Application Priority Data

Jan. 31, 2017 (JP) ..... 2017-015101

(51) Int. Cl.
*B41J 2/175* (2006.01)

(52) U.S. Cl.
CPC ..... *B41J 2/17513* (2013.01); *B41J 2/1752* (2013.01); *B41J 2/17506* (2013.01); *B41J 2/17553* (2013.01); *B41J 2/17559* (2013.01); *B41J 2/17566* (2013.01); *B41J 2002/17573* (2013.01)

(58) Field of Classification Search
CPC ... B41J 2/17513; B41J 2/17506; B41J 2/1752
See application file for complete search history.

(56) References Cited

U.S. PATENT DOCUMENTS 4,589,000 A * 5/1986 Koto ..... B41J 2/16544 347/30
6,846,072 B2 * 1/2005 Sato ..... B41J 3/445 347/86
2014/0183087 A1 * 7/2014 Weaver ..... B65D 25/14 206/524.3
2016/0052286 A1 * 2/2016 Kimura ..... B41J 2/17509 347/86
2017/0129246 A1 5/2017 Kimura et al.

FOREIGN PATENT DOCUMENTS

JP 2015-164812 A 9/2015

* cited by examiner

*Primary Examiner* — Jason S Uhlenhake
(74) *Attorney, Agent, or Firm* — Foley & Lardner LLP

(57) ABSTRACT

Various defects that occur when a water-repellent or defoaming layer is formed on a contact portion of a liquid container are reduced. A method for manufacturing a liquid container for containing a liquid includes: (a) preparing a pre-formation liquid container in which a surface layer has not been formed; (b) bringing an aqueous solution obtained by adding water to one of a defoaming agent and a water-repellent agent into contact with a surface of a contact portion with which the liquid is brought into contact, of the pre-formation liquid container; and (c) drying, after the step (b), the contact portion to form the surface layer that is formed of one of the defoaming agent and the water-repellent agent on a surface of the contact portion.

16 Claims, 9 Drawing Sheets

METHOD FOR MANUFACTURING LIQUID CONTAINER, AND LIQUID CONTAINER

CROSS REFERENCE TO RELATED APPLICATIONS

The present application claims priority from Japanese Patent Application No. 2017-015101 filed on Jan. 31, 2017, the contents of which are hereby incorporated by reference into this application.

BACKGROUND

1. Technical Field

The present invention relates to a technique for a liquid container.

2. Related Art

Heretofore, a tank for containing ink has been known (e.g., JP-A-2015-164812).

In the hitherto known technique, the tank has a specific portion through which the interior can be viewed from the exterior, and thus a user can view the liquid inside of the tank via this portion. Also, with the hitherto known technique, a layer of coating material that contains fluorine resin or a fluorine compound, which are water-repellent substances, is formed on the surface of the specific portion.

However, if the water-repellent substance is formed as a layer on the surface of the specific portion, various defects occur in some cases before the water-repellent substance is fixed to the surface of the specific portion. For example, if the water-repellent substance is fixed through a heat treatment after the specific portion is coated with the water-repellent substance, the tank may be damaged through the heat treatment. Also, for example, if an alcohol such as methanol is used as the solvent for the water-repellent substance, there is a risk that the environmental load will increase.

Accordingly, hereinbefore, there has been desire for a technique according to which a layer of a water-repellent agent can be formed on the specific portion of the tank and the occurrence of the various defects can be reduced. Note that this kind of request is also present in the case where a layer of a water-repellent agent is formed not only on the specific portion, but also on a contact portion with which the liquid comes into contact. Also, this kind of request is present not only in the case of forming a layer of a water-repellent agent, but also in the case of forming a layer of a defoaming agent on the contact portion. Also, this kind of request is present not only for a tank that contains ink, but also for liquid containers for containing various types of liquid.

SUMMARY

The invention was made in order to solve at least a portion of the above-described problems, and can be realized as the following modes or applied examples.

(1) According to a mode of the invention, a method for manufacturing a liquid container for containing a liquid is provided. This method for manufacturing a liquid container includes: (a) preparing a pre-formation liquid container in which a surface layer has not been formed; (b) bringing an aqueous solution obtained by adding water to one of a defoaming agent and a water-repellent agent into contact with a surface of a contact portion with which the liquid is brought into contact, of the pre-formation liquid container; and (c) drying the contact portion after the step (b) to form the surface layer that is formed of one of the defoaming agent and the water-repellent agent on a surface of the contact portion. According to this mode, a surface layer that is formed using a defoaming agent or a water-repellent agent can be formed easily on a surface of a contact portion through a hydrophobic effect by bringing an aqueous solution obtained by adding water to one of a defoaming agent and a water-repellent agent into contact with the surface of the contact portion. For example, after the aqueous solution of the defoaming agent or the aqueous solution of the water-repellent agent is brought into contact with (applied to) the surface of the contact portion, the surface layer can be formed through natural drying without performing a heating treatment. Accordingly, it is possible to reduce the likelihood that the liquid container will be damaged by being heated. Also, by using water as the solvent for the defoaming agent or the water-repellent agent, it is possible to reduce the risk that the environmental load will increase compared to the case of using an alcohol such as methanol as the solvent.

(2) In the above-described mode, at least one of the defoaming agent and the water-repellent agent may be a silicone-based surfactant. According to this mode, it is possible to reduce the likelihood that the environmental load will increase compared to the case of using a fluorine-based surfactant as the defoaming agent or the water-repellent agent.

(3) In the above-described mode, the silicone-based surfactant may contain siloxane. According to this mode, a silicone surfactant containing siloxane can be used.

(4) In the above-described mode, at least one of the defoaming agent and the water-repellent agent may be a fluorine-based surfactant. According to this mode, the fluorine-based surfactant can be used as the defoaming agent or the water-repellent agent.

(5) In the above-described mode, the pre-formation liquid container may include a liquid containing chamber that can contain the liquid, and the step (b) may include causing the aqueous solution to come into contact with at least a portion of a surface of a containing chamber forming wall that forms the liquid containing chamber. According to this mode, for example, by forming the surface layer of the water-repellent agent on at least a portion of the surface of the containing chamber forming wall, it is possible to reduce the likelihood that the liquid will attach to and remain on the portion on which the surface layer is formed. Accordingly, for example, it is possible to suppress the occurrence of foreign matter that occurs due to the liquid such as ink drying. Also, for example, by forming the surface layer of the defoaming agent on at least a portion of the surface of the containing chamber forming wall, it is possible to eliminate bubbles quickly, even in the case where bubbles occur in the liquid containing chamber during movement, such as transport, of the liquid container.

(6) In the above-described mode, the containing chamber forming wall may include a viewing wall through which the liquid contained in the liquid containing chamber can be viewed from the exterior, and the step (b) may include causing the aqueous solution to come into contact with at least one of an inner surface and an outer surface of the viewing wall. According to this mode, for example, a surface layer of the water-repellent agent can be formed on at least one of the inner surface and the outer surface of the viewing wall, and therefore it is possible to reduce the likelihood that the liquid will attach to and remain on the surface of the viewing wall. Accordingly, the user can easily view the interior of the liquid containing chamber via the viewing wall. Also, for example, the surface layer of the defoaming agent can be formed on at least one of the inner surface and the outer surface of the viewing wall, and therefore it is possible to reduce the likelihood that bubbles will attach to and remain on the viewing wall. Accordingly, the user can easily view the interior of the liquid containing chamber via the viewing wall.

(7) In the above-described mode, the liquid container may further include a liquid inlet portion, through which the liquid is injected into the liquid containing chamber. According to this mode, when the liquid is injected into the interior of the liquid containing chamber via the liquid inlet portion, it is possible to reduce the likelihood that the liquid will attach to the portion on which the surface layer is formed, or the likelihood that bubbles will attach to the portion on which the surface layer is formed. Accordingly, the user can more easily view the interior of the liquid containing chamber via the viewing wall. Also, for example, due to the surface layer of the defoaming agent being formed, bubbles can be eliminated quickly even if bubbles occur in the liquid containing chamber when the liquid is injected into the liquid containing chamber, and therefore it is possible to reduce the likelihood that the liquid including bubbles will overflow from the liquid inlet portion.

(8) In the above-described mode, the pre-formation liquid container may include an atmosphere communication path that causes the liquid containing chamber and an atmosphere to be in communication, and the step (b) may include causing the aqueous solution to come into contact with at least a portion of an inner surface of a communication path forming wall that forms the atmosphere communication path. According to this mode, even if the liquid enters an atmosphere communication path, it is possible to allow the liquid to flow out from the atmosphere communication path quickly. Accordingly, it is possible to reduce the likelihood that the atmosphere communication path will be blocked by the liquid.

(9) In the above-described mode, the pre-formation liquid container may further include a detection member for detecting a remaining amount of liquid in the liquid containing chamber according to whether or not the detection member is in contact with the liquid, and the step (b) may include bringing the aqueous solution into contact with the surface of the detection member. With this mode, it is possible to reduce the likelihood that the accuracy of detecting the remaining amount of the liquid using the detection member will decrease.

(10) According to another mode of the invention, a liquid container for containing a liquid is provided. This liquid container includes a contact portion with which the liquid comes into contact, and a surface layer formed of at least one of a defoaming agent and a water-repellent agent, which are dissolved in water, is formed. According to this mode, by bringing at least one of the defoaming agent and the water-repellent agent, which are dissolved in water, into contact with the surface of the contact portion, it is possible to easily form the surface layer that is formed using the defoaming agent or the water-repellent agent on the surface on the contact portion through the hydrophobic effect. For example, after the defoaming agent or the water-repellent agent, which are dissolved in water, are brought into contact with (applied to) the surface of the contact portion, the surface layer can be formed through natural drying without performing a heating treatment. Accordingly, it is possible to reduce the likelihood that the liquid container will be damaged by being heated. Also, by using water as the solvent for the defoaming agent or the water-repellent agent, it is possible to reduce the risk that the environmental load will increase compared to the case of using an alcohol such as methanol as the solvent.

The invention can also be realized in various modes other than the method for manufacturing a liquid container. For example, realization thereof is possible in modes such as a liquid container, or a liquid ejection system that includes a liquid container and a liquid ejection apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

Figure 1:
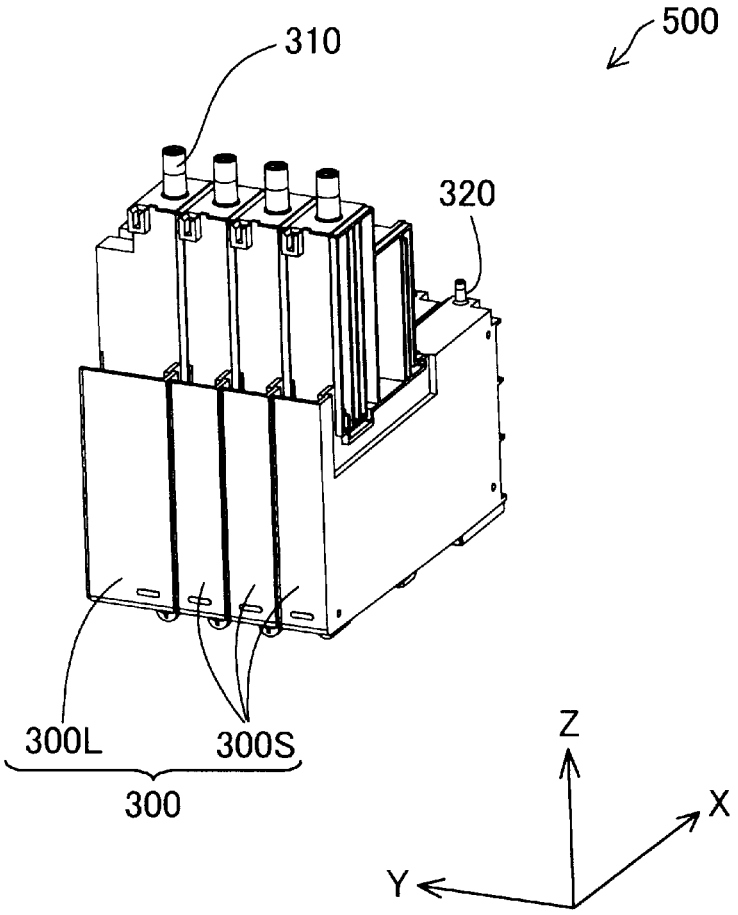
FIG. 1 is a perspective view of a liquid supply apparatus that has liquid containers.

A-1. Configuration of Liquid Supply Apparatus:

FIG. 1 is a schematic view of a liquid supply apparatus 500 that includes liquid containers 300 serving as an embodiment of the invention. X, Y, and Z axes that are orthogonal to each other are included in FIG. 1. The X, Y, and Z axes are included in subsequent drawings as well, according to need. The −Z-axis direction is the gravity direction and the +Z-axis direction is the direction of going against gravity.

A liquid supply apparatus 500 supplies ink serving as the liquid to an ink jet printer, which is an example of a liquid ejection apparatus. The liquid supply apparatus 500 communicates with a liquid ejection portion (printing head) of the liquid ejection apparatus.

The liquid supply apparatus 500 includes multiple liquid containers 300. In the present embodiment, four liquid containers 300 are provided. The multiple liquid containers 300 are arranged in alignment in a predetermined direction (in the present embodiment, the Y-axis direction). The liquid containers 300 can contain the ink serving as the liquid to be supplied to the liquid ejection portion. The liquid containers 300 each include a liquid outlet 320 for guiding the liquid to the liquid ejection portion and a liquid inlet portion 310, through which the liquid is injected into the liquid container 300 (specifically, a later-described liquid containing chamber). A liquid flow-through pipe such as a tube is connected to the liquid outlet 320 and the liquid that flows through the liquid flow-through pipe is supplied to the liquid ejection apparatus.

The four liquid containers 300 are constituted by one liquid container 300L and three liquid containers 300S. The liquid container 300L has a larger volume than the liquid container 300S. For example, the liquid container 300L contains black ink, which has a large consumption amount, and the other liquid containers 300S contain other inks (for example, magenta ink, cyan ink, yellow ink, and the like, which are chromatic colors). Note that the number and types of ink can be set arbitrarily. In the following description, if it is not necessary to make a distinction between the two types of liquid containers 300S and 300L, they are collectively referred to as "liquid containers 300". Any members, such as synthetic resin and flexible film, can be used as the members constituting the liquid containers 300.

Figure 2:
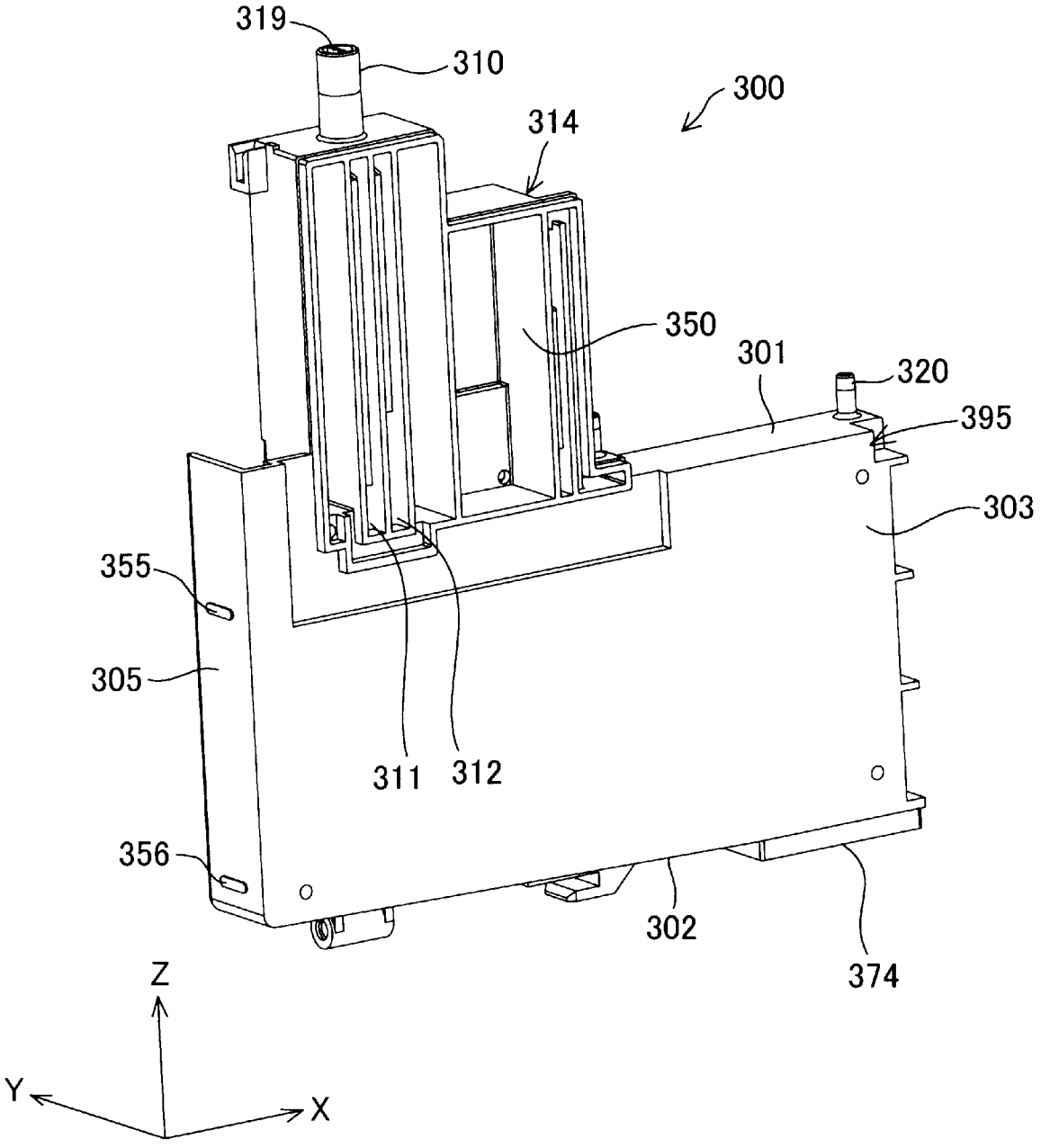
FIG. 2 is a first perspective view of a liquid container.
Figure 3:
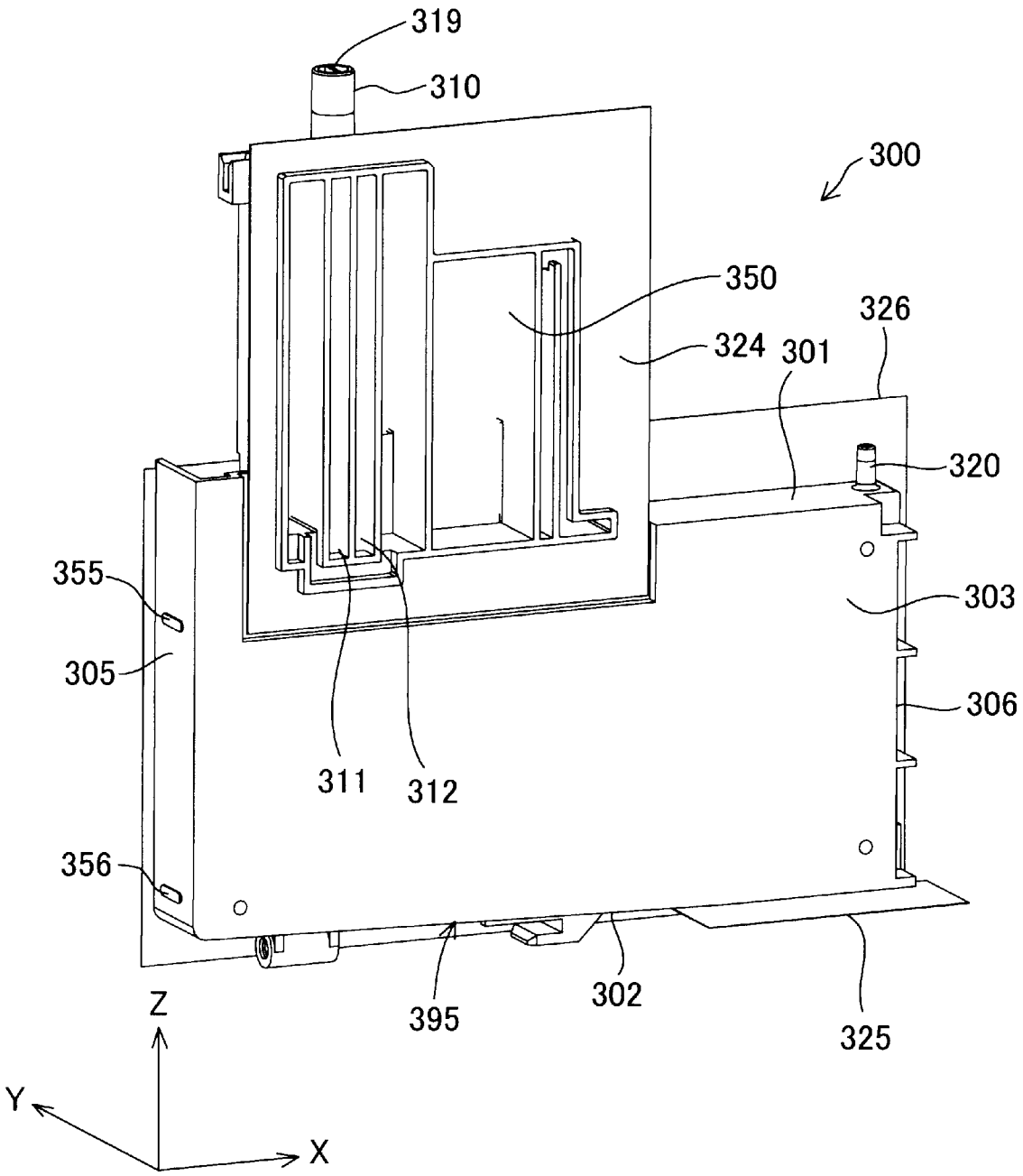
FIG. 3 is a second perspective view of the liquid container.
Figure 4:
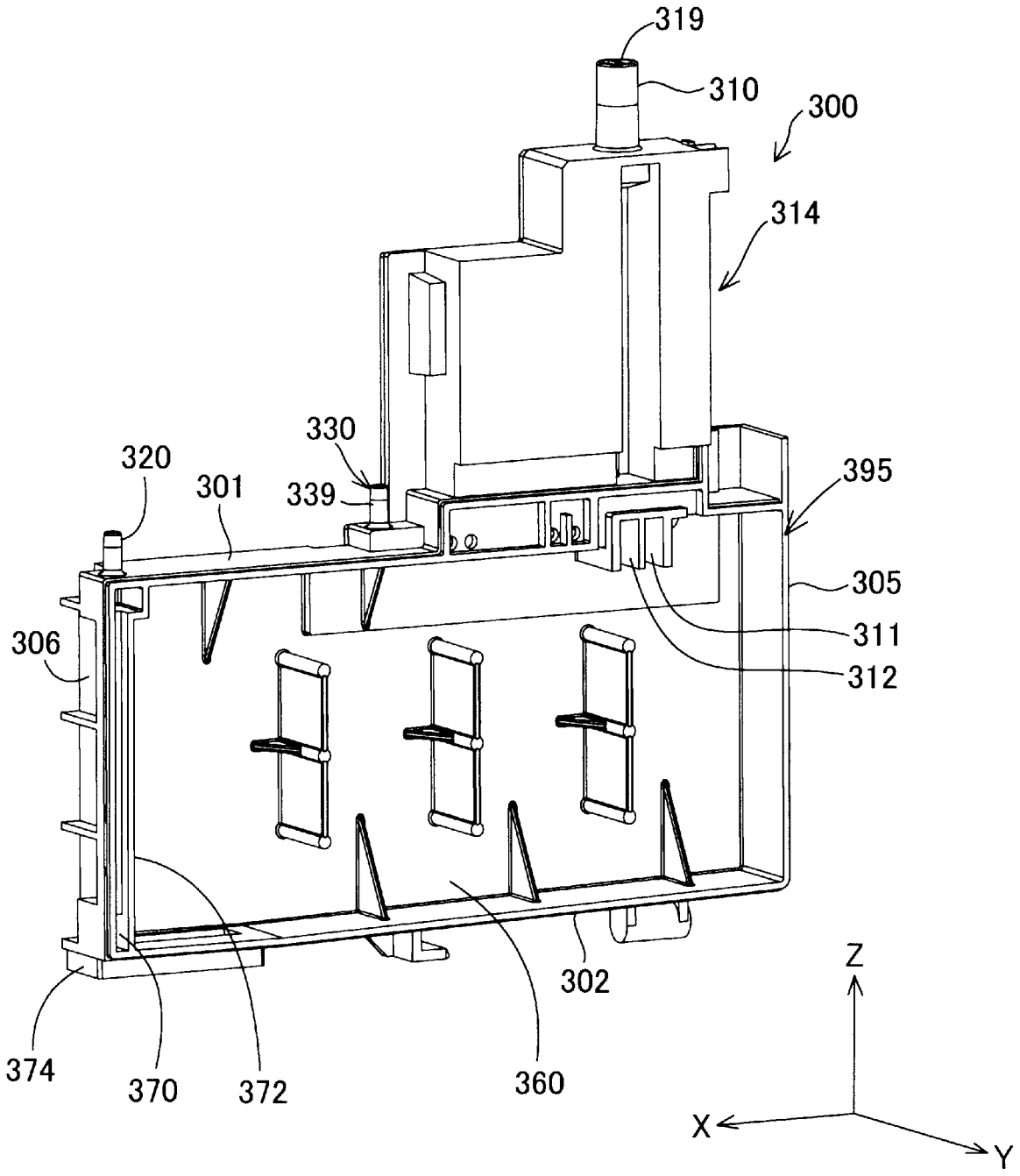
FIG. 4 is a third perspective view of the liquid container.
Figure 5:
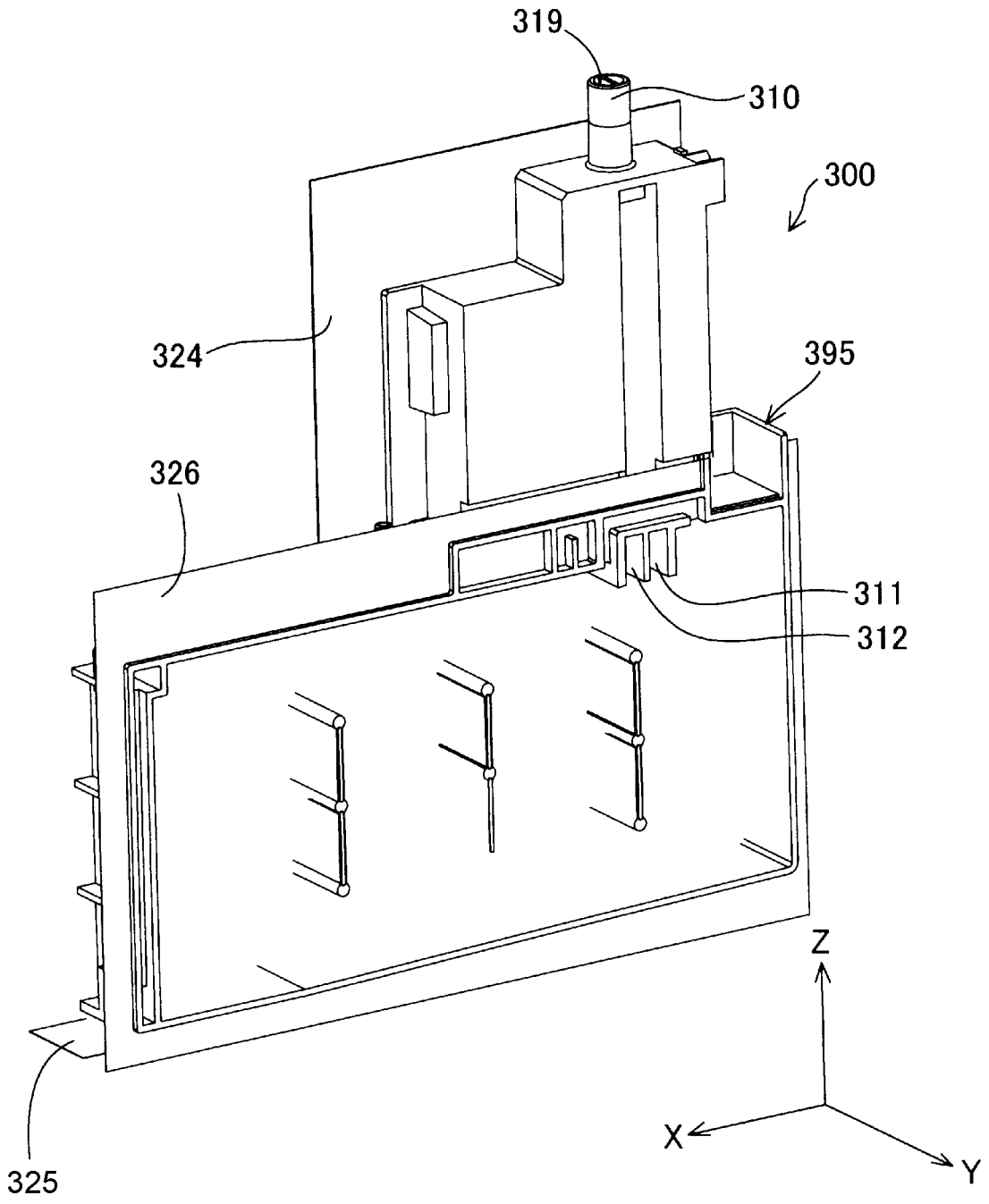
FIG. 5 is a fourth perspective view of the liquid container.

FIG. 2 is a first perspective view of the liquid container 300. FIG. 3 is a second perspective view of the liquid container 300. FIG. 4 is a third perspective view of the liquid container 300. FIG. 5 is a fourth perspective view of the liquid container 300. FIG. 2 shows a state in which liquid-impermeable films 324 to 326 are not adhered to a main body 314, and FIG. 3 shows a state in which the films 324 to 326 are adhered to the main body 314. Also, FIG. 4 shows a state in which the films 324 to 326 are not adhered to the main body 314, and FIG. 5 shows a state in which the films 324 to 326 are adhered to the main body 314. Note that in these examples, the films 324 to 326 are transparent.

Various rooms of the liquid container 300 are formed in the main body 314 of the liquid container 300 due to the films 324 to 326 being adhered thereto. The main body 314 is formed of a synthetic resin such as polypropylene (PP) or polyethylene (PE). In the present embodiment, the main body 314 is formed of polypropylene.

The liquid container 300 includes a liquid containing chamber 360 (FIG. 4), a liquid inlet portion 310 (FIG. 4), an atmosphere communication path 330 (FIG. 4), an air chamber 350 (FIG. 3), and a liquid supply path 370 (FIG. 4).

The liquid containing chamber 360 can contain a liquid. The liquid containing chamber 360 is formed by adhering the film 326 to the main body 314. In other words, the main body 314 and the film 326 form a containing chamber forming wall 395 that forms the liquid containing chamber 360. The containing chamber forming wall 395 (FIG. 4) includes an upper wall 301, a bottom wall 302, a first side wall 303 (FIG. 3), the film 326 serving as a second side wall, a viewing wall 305 serving as a third side wall, and a fourth side wall 306. The upper wall 301 and the bottom wall 302 oppose each other in the gravity direction. The first side wall 303, the film 326, the viewing wall 305, and the fourth side wall 306 are walls that connect the upper wall 301 and the bottom wall 302. The viewing wall 305 is configured such that the liquid stored in the liquid storage chamber 360 is visible from the exterior. In the present embodiment, the viewing wall 305 is formed to be transparent or translucent, and thus the liquid contained in the liquid containing chamber 360 can be viewed from the exterior. With the viewing wall 305, the user can check the amount of liquid in the liquid containing chamber 360.

The viewing wall 305 includes an upper limit indication portion 355 for indicating the upper limit of the liquid contained in the liquid containing chamber 360, and a lower limit indication portion 356 for indicating a time for replenishing the liquid in the liquid containing chamber 360. The upper limit indication portion 355 and the lower limit indication portion 356 are marks that extend in the horizontal direction. Note that the upper limit indication portion 355 and the lower limit indication portion 356 need not be marks and may have another configuration, as long as identification is possible for the user. For example, the upper limit indication portion 355 and the lower limit indication portion 356 may be marks that are triangular, or the like. When the liquid is being replenished, the liquid surface reaching the upper limit indication portion 355 of the liquid containing chamber 360 is used as a guide for the user to stop replenishing. Also, the user replenishes the liquid containing chamber 360 with the liquid when the liquid surface is located at or under the lower limit indication portion 356 as a guide to need replenishment of the liquid into the liquid containing chamber 360.

The liquid inlet portion 310 (FIG. 4) is used to receive the liquid into the liquid containing chamber 360. The user can inject the liquid into the liquid containing chamber 360 via the liquid inlet portion 310 while checking the amount of liquid in the liquid containing chamber 360 through the viewing wall 305. Two liquid introduction paths 311 and 312 (FIG. 3) that are located apart from each other are formed inside of the liquid inlet portion 310. The lower ends of the liquid introduction paths 311 and 312 (i.e., the lower end of the liquid inlet portion 310) are open in the liquid containing chamber 360 (FIG. 4), which is at a lower area of the liquid container 300. When the liquid is injected into the liquid containing chamber 360, a connection port of a liquid container for replenishing is placed against an opening 319 of the liquid inlet portion 310 and the liquid is injected from the liquid container for replenishing. At this time, one of the two liquid introduction portions 311 and 312 functions as a path for discharging air from the liquid container 300 to the liquid container for replenishing, and the other functions as an injection path for liquid. As a result, the liquid is injected into the liquid containing chamber 360 through gas-liquid exchange. Note that when injection of liquid is not performed, the opening 319 at the upper portion of the liquid inlet portion 310 is sealed with a cap.

The air chamber 350 (FIG. 3) is provided laterally of the liquid inlet portion 310. The air chamber 350 is in communication with the upper portion of the liquid containing chamber 360. The liquid introduction paths 311 and 312 of the liquid inlet portion 310 and the air chamber 350 are open to the exterior in the state shown in FIG. 2, but the opening portions thereof are closed by the film 324 in the state shown in FIG. 3.

The atmosphere communication path 330 (FIG. 4) causes the liquid containing chamber 360 and the atmosphere to be in communication. The atmosphere communication path 330 is a cylindrical member provided on the upper wall 301 of the liquid containing chamber 360. The atmosphere communication path 330 is formed by the main body 314. The wall of the main body 314 that forms the atmosphere communication path 330 is also called the communication path forming wall 339.

One end of the atmosphere communication path 330 opens toward the exterior and the other end opens in the liquid containing chamber 360. As the liquid in the liquid containing chamber 360 is consumed, the atmosphere (air) is introduced into the liquid containing chamber 360 through the atmosphere communication path 330. Note that the atmosphere communication path 330 may communicate with a buffer chamber that contains the air, via an atmosphere flow-through pipe, such as a tube. The buffer chamber communicates with the atmosphere, and the atmosphere may be introduced into the liquid storage chamber 360 via the buffer chamber, the atmosphere flow-through pipe, and the atmosphere communication path 330. By providing the buffer chamber, it is possible to further reduce the likelihood that the liquid in the liquid containing chamber 360 will leak to the exterior. Also, the atmosphere communication path 330 may be set as a winding flow path. By doing so, it is possible to reduce the likelihood that the liquid will flow out to the exterior through the atmosphere communication path 330.

The liquid supply path 370 communicates with the liquid containing chamber 360 via a communication path 374 that is provided in an open state below the bottom wall 302 of the main body 314. In the states shown in FIGS. 3 and 5, the opening portion on the lower portion of the communication path 374 is hermetically sealed by the film 325. One end of the liquid supply path 370 is the liquid outlet 320, and the liquid that flows through the liquid supply path 370 is supplied to a liquid jet head.

Figure 6:
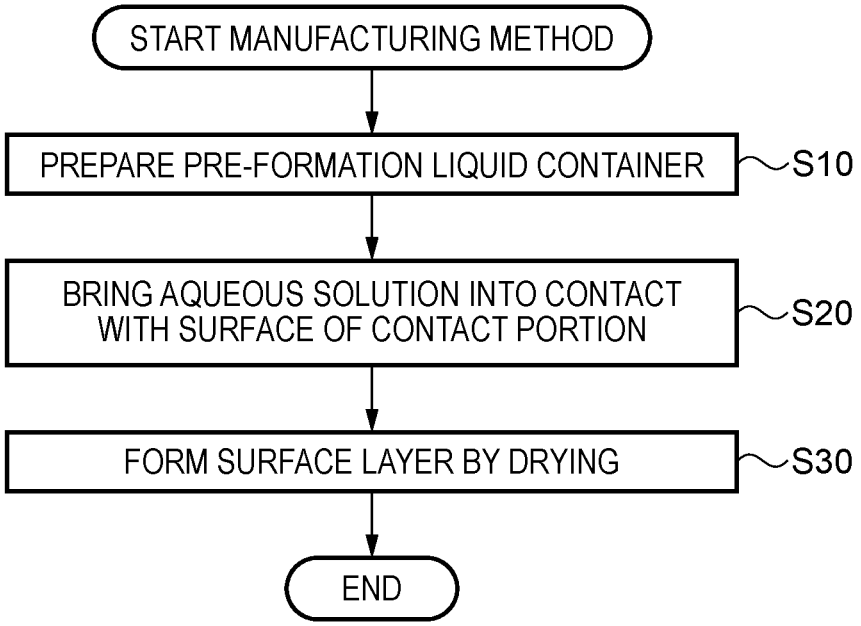
FIG. 6 is a flow diagram of a method for manufacturing a liquid container.
Figure 7:
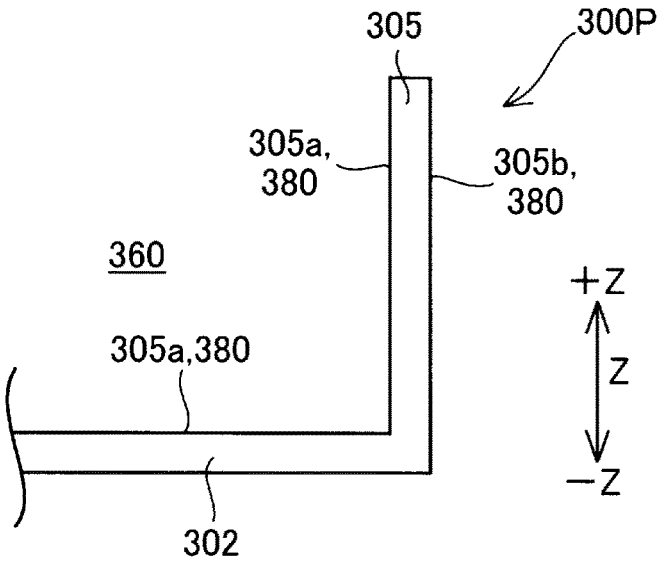
FIG. 7 is a schematic diagram showing a portion of a pre-formation liquid container in which a surface layer has not been formed.
Figure 8:
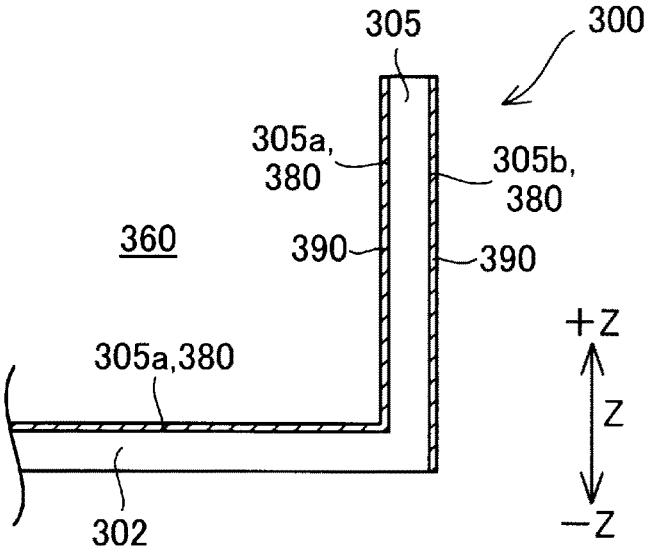
FIG. 8 is a schematic diagram showing a portion of a liquid container in which the surface layer is formed.
Figure 9:
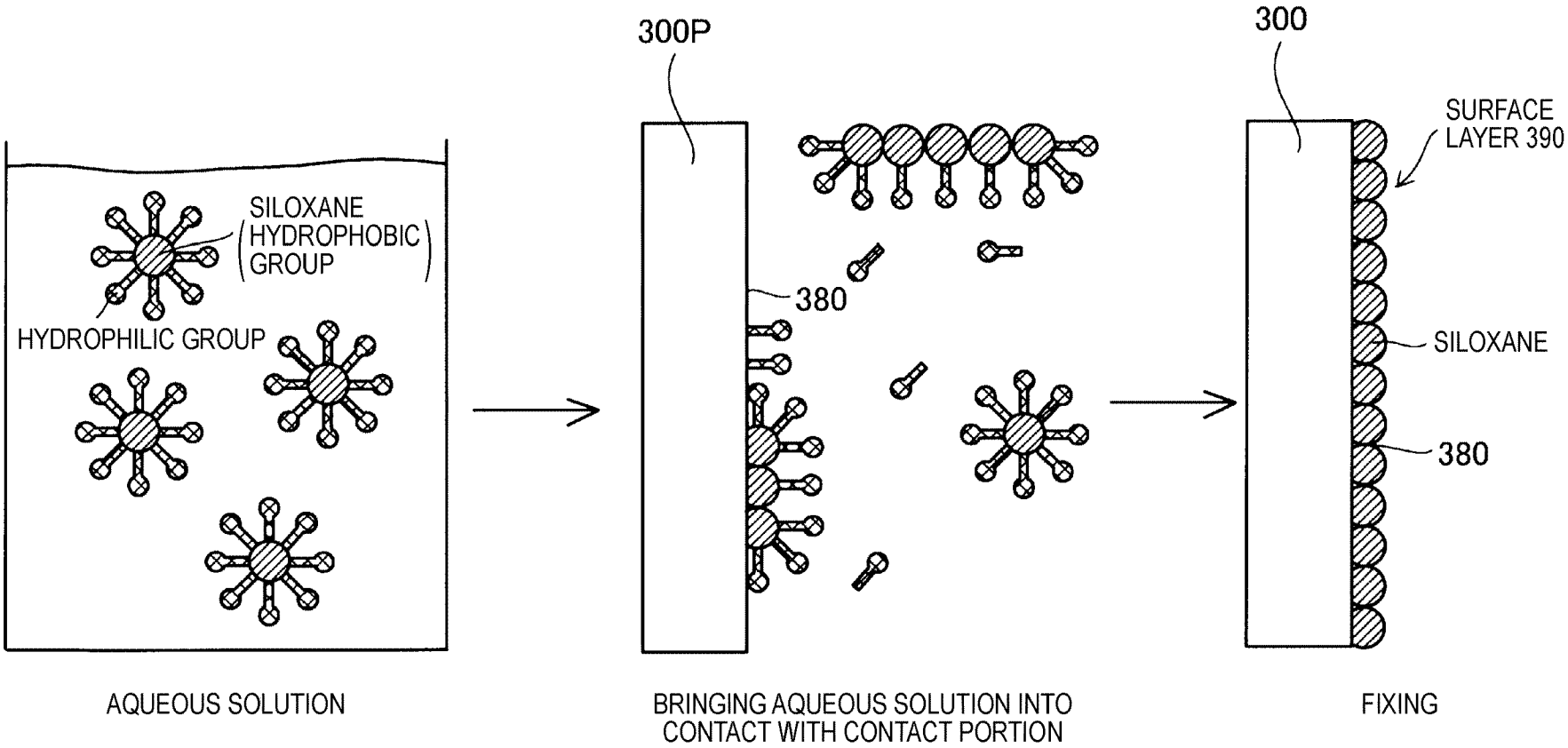
FIG. 9 is a diagram for schematically illustrating a principle of forming the surface layer.

A-2. Method for Manufacturing Liquid Container:

FIG. 6 is a flow diagram for a method for manufacturing the liquid container 300. FIG. 7 is a schematic diagram showing a portion of a pre-formation liquid container 300P in which a surface layer 390 has not been formed. FIG. 8 is a schematic diagram showing a portion of the liquid container 300 in which the surface layer 390 has been formed. FIG. 9 is a diagram for schematically illustrating a principle of forming the surface layer 390.

As shown in FIG. 6, first, the pre-formation liquid container 300P in which the surface layer 390 has not been formed is prepared (step S10). The shape of the pre-formation liquid container 300P is the same as the shape of the liquid container 300 (FIG. 2), and is formed by the main body 314 and the films 324 to 326.

Next, a solution obtained by adding water (purified water) to one of a defoaming agent and a water-repellent agent is brought into contact with the surface of a contact portion 380 (FIG. 7) with which the liquid comes into contact, of the pre-formation liquid container 300P (step S20). The contact portion 380 is not limited to being a portion with which the liquid actually comes into contact, and may include portions with which the liquid is likely to come into contact. In the present embodiment, the contact portion 380 includes an inner surface 305*a*, which is the inner surface of the containing chamber forming wall 395 that forms the liquid containing chamber 360, an outer surface 305*b*, which is the outer surface of the viewing wall 305, and an inner surface, which is the inner-side surface of the communication path forming wall 339 that forms the atmosphere communication path 330. In other words, the aqueous solution obtained by adding water (purified water) to one of the defoaming agent and the water-repellent agent (e.g., a diluted solution) is brought into contact with the inner surface 305*a* of the containing chamber forming wall 395 that includes the inner surface of the viewing wall 305, and the inner surface of the communication path forming wall 339.

An agent that has a bubble height that is somewhat low after bubbles are formed in the liquid (in this example, ink) and the liquid is left for a certain amount of time is preferable as the defoaming agent. Also, a silicone-based surfactant or a fluorine-based surfactant may be used as the defoaming agent. Any of product name KM-71 or product name KM-75 manufactured by Shin-Etsu Chemical Co., Ltd., or product name BYK-093 or product name BYK-094 manufactured by BYK Additives and Instruments may be used as the silicone-based surfactant. Also, any of product number F-555 or product number F-558 of MEGAFACE manufactured by DIC Corporation may be used as the fluorine-based surfactant.

An agent with a somewhat large angle (angle of contact) that is formed between the liquid surface of the liquid (in the present embodiment, ink) and the solid surface is preferable as the water-repellent agent. Also, in the present embodiment, a silicone-based surfactant or a fluorine-based surfactant may be used as the water-repellent agent. Any of product name NP-2804 manufactured by Wacker Asahikasei Silicone Co., Ltd., and MODIPER (registered trademark) FS770 manufactured by NOF Corporation may be used as the silicone surfactant. Also, any of model number FS-6130 of Fluoro Surf manufactured by Fluoro Technology and product name AG-E061 of AsahiGuard E-Series manufactured by Asahi Glass Co., Ltd. may be used as the fluorine-based surfactant.

By using the silicone-based surfactant as at least one of the defoaming agent and the water-repellent agent, it is possible to reduce the likelihood that the environmental load will increase compared to the case of using a fluorine-based surfactant. For example, it is possible to reduce an adverse influence on the environment when the defoaming agent or the water-repellent agent is disposed of.

Also, the silicone-based surfactant may include siloxane. For example, product name MS-575 of FOAM BAM (registered trademark) manufactured by Munzing Corporation may be used as a silicone-based surfactant containing siloxane.

In step S20, a diluted solution obtained by diluting the defoaming agent or the water-repellent agent with purified water is brought into contact with the contact portion 380. Although there is no particular limitation on the concentration of the diluted defoaming agent or water-repellent agent, the defoaming agent or the water-repellent agent (e.g., siloxane) may be diluted with purified water, which is the solvent, to 0.5 mass % or more and 5.0 mass % or less, and may be diluted with purified water, which is the solvent, to 1 mass % or more and 2.0 mass % or less. Also, in step S20, if the contact portion 380 is the inner surface 305*a* of the containing chamber forming wall 395 and the inner surface of the communication path forming wall 339 that forms the atmosphere communication path 330, the following method may be used as the method for bringing the diluted solution into contact with the surface of the contact portion 380. For example, it is sufficient to fill the liquid containing chamber 360 and the atmosphere communication path 330 of the pre-formation liquid container 300P with the diluted solution by injecting the diluted solution (aqueous solution) from the liquid inlet portion 310. Also, if the contact portion 380 is the outer surface 305*b* of the viewing wall 305, as the method for bringing the diluted solution (aqueous solution) into contact with the surface of the contact portion 380, for example, it is sufficient to cause a contact pad such as a sponge to absorb the diluted solution and press the contact pad against the outer surface 305*b* of the viewing wall 305 to bring the diluted solution into contact therewith.

The amount of time of contact between the diluted solution (aqueous solution) and the contact portion 380 need only be an amount of time according to which the water-repellent agent or the defoaming agent is fixed to the surface of the contact portion 380. For example, the contact time need only be 0.1 seconds or more, or more preferably 1.0 seconds or more. Accordingly, the surface layer 390 is formed due to the water-repellent agent or the defoaming agent being fixed to the inner surface 305*a* of the liquid containing chamber 360 and the inner surface of the atmosphere communication path 330 through hydrophobic adsorption (hydrophobic effect) between the liquid containing chamber 360 and the atmosphere communication path 330 that are formed of hydrophobic members, and the water-repellent agent or defoaming agent contained in the diluted solution.

If product name MS-575 of FOAM BAM (registered trademark) is used as the water-repellent agent, as shown in FIG. 9, hydrophilic groups formed by using water as a solvent are separated from hydrophobic siloxane, whereby the siloxane aggregates, and the siloxane is fixed to the surface of the hydrophobic contact portion 380 through the hydrophobic effect.

After step S20, the surface of the contact portion 380 is dried, whereby the surface layer 390, which is formed using one of the defoaming agent and the water-repellent agent, is formed on the surface of the contact portion 380 (step S30 in FIG. 6). For example, if a diluted solution containing one of the defoaming agent and the water-repellent agent is injected from the liquid inlet portion 310 of the pre-formation liquid container 300P, the diluted solution is discharged to the exterior from the liquid inlet portion 310. Thereafter, the surface of the contact portion 380 is dried through natural drying without performing a heating treatment. Also, if the contact pad has been pressed against the contact portion 380, the contact pad is removed from the contact portion 380 and natural drying is performed without performing a heating treatment. Accordingly, the surface layer 390 formed by one of the defoaming agent and the water-repellent agent is formed on the surface of the contact portion 380.

According to the above-described embodiment, water is used as the solvent for the defoaming agent or the water-repellent agent, and therefore the surface layer 390 can be formed easily on the surface of the contact portion 380 using the hydrophobic effect. For example, after the aqueous solution of the defoaming agent or the aqueous solution of the water-repellent agent is brought into contact with (applied to) the surface of the contact portion 380, the surface layer 390 can be formed through natural drying without performing a heating treatment. Accordingly, it is possible to reduce the likelihood that the liquid container 300 will be damaged by undergoing a heating treatment. Also, by using water as the solvent for the defoaming agent or the water-repellent agent, it is possible to reduce the risk that the environmental load will increase compared to the case of using an alcohol such as methanol as the solvent.

Also, according to the above-described embodiment, for example, by forming the surface layer 390 of the defoaming agent on at least a portion of the surface of the containing chamber forming wall 395, it is possible to reduce the likelihood that the liquid will attach to and remain on the portion on which the surface layer 390 is formed. If the liquid remains on the inner surface 305*a* of the containing chamber forming wall 395, the liquid will dry and foreign matter with a high viscosity will occur in some cases. However, with the present embodiment, since it is possible to reduce the likelihood that the liquid will remain on the inner surface 305*a* due to the surface layer 390, it is possible to suppress the occurrence of the foreign matter with the high viscosity. Also, for example, by forming the surface layer 390 of the defoaming agent on at least a portion of the inner surface 305*a* of the containing chamber forming wall 395, bubbles can be eliminated quickly even if bubbles occur in the liquid containing chamber 360 during movement, such as transport, of the liquid container 300.

Also, according to the above-described embodiment, the surface layer 390 of the water-repellent agent can be formed on at least one of the inner surface 305*a* and the outer surface 305*b* of the viewing wall 305, and therefore it is possible to reduce the likelihood than the liquid will attach to and remain on the surface of the viewing wall 305. Accordingly, the user can easily view the interior of the liquid containing chamber 360 via the viewing wall 305. Also, for example, since the surface layer 390 of the defoaming agent can be formed on at least one of the inner surface 305*a* and the outer surface 305*b* of the viewing wall 305, it is possible to reduce the likelihood that bubbles will attach to and remain on the viewing wall 305. Accordingly, the user can easily view the interior of the liquid containing chamber 360 via the viewing wall 305. Here, in the hitherto known technique, with the liquid container 300 that contains a dark-colored ink such as black ink, a problem can occur in which it takes time from when the user fills the ink in the liquid containing chamber 360 via the liquid inlet portion 310 to when the amount of remaining liquid in the liquid containing chamber 360 can be viewed via the viewing wall 305. According to the above-described embodiment, the surface layer 390 of the water-repellent agent can be formed on at least one of the inner surface 305*a* and the outer surface 305*b* of the viewing wall 305, and therefore it is possible to reduce the likelihood that the liquid will attach to and remain on the surface of the viewing wall 305 also with the liquid container 300 that contains a dark-colored ink. Accordingly, the user can easily view the interior of the liquid containing chamber 360 via the viewing wall 305.

Also, according to the above-described embodiment, it is possible to reduce the likelihood that the liquid will attach to the portion on which the surface layer 390 is formed, or the likelihood that bubbles will attach to the portion on which the surface layer 390 is formed, when the liquid is injected into the liquid containing chamber 360 via the liquid inlet portion 310. Accordingly, the user can more easily view the interior of the liquid containing chamber 360 via the viewing wall 305. Also, for example, due to the surface layer 390 of the defoaming agent being formed, bubbles can be eliminated quickly even if bubbles occur in the liquid containing chamber 360 when the liquid is injected into the liquid containing chamber 360, and therefore it is possible to reduce the likelihood that the liquid including bubbles will overflow from the liquid inlet portion 310.

Also, with the above-described embodiment, the surface layer 390 is formed on at least a portion of the inner surface of the communication path forming wall 339, whereby even if liquid has entered the atmosphere communication path 330 from the liquid containing chamber 360, it is possible to cause the liquid in the atmosphere communication path 330 to quickly flow out to another portion (e.g., the liquid containing chamber 360). Accordingly, it is possible to reduce the likelihood that the atmosphere communication path 330 will be blocked by the liquid.

B. Modified Example

Note that the invention is not limited to the above-described working examples and embodiments, and can be carried out in various modes without departing from the gist, and for example, the following modification is also possible.

B-1. First Modified Example

Figure 10:
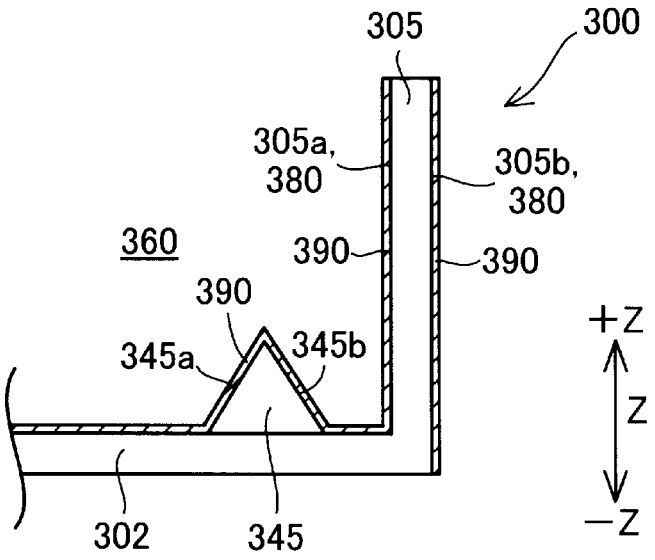
FIG. 10 is a diagram for illustrating a first modified example.

FIG. 10 is a diagram for illustrating a first modified example. In the above-described embodiment, the liquid container 300 may include a detection member 345 for detecting an amount of remaining liquid in the liquid containing chamber 360 according to whether or not the detection member 345 is in contact with the liquid. The detection member 345 is a triangular prism and is formed of synthetic resin such as acrylic resin. The detection member 345 includes an incident surface 345*a* and a reflection surface 345*b*. The surface layer 390 may be formed on at least the incident surface 345*a* and the reflection surface 345*b*, which are surfaces of the detection member 345.

The detection member 345 is arranged on the bottom wall 302 of the liquid containing chamber 360. If the liquid container 300 includes the detection member 345, the liquid ejection apparatus includes a light-emitting element that emits light to the detection member and a light-receiving element for receiving the light reflected from the detection member. The light incident on the detection member 345 from the light-emitting element is diffused in the liquid if the periphery of the detection member 345 is filled and the liquid is in contact with the detection member 345 (specifically, the incident surface 345*a* and the reflection surface 345*b*). In this case, a light reception signal is not output from the light-receiving element to the control unit of the liquid ejection apparatus, and the control unit determines that there is an amount of remaining liquid in the liquid containing chamber 360.

On the other hand, if no liquid is present in the periphery of the detection member 345 and no liquid is in contact with the detection member 345 (specifically, the incident surface 345*a* and the reflection surface 345*b*), the light incident on the incident surface 345*a* of the detection member 345 from the light-emitting element is reflected by the incident surface 345*a* and the reflection surface 345*b* and is received by the light-receiving element. Accordingly, due to the light reception signal being output from the light-reception element to the control unit of the liquid ejection apparatus, the control unit determines that there is no amount of remaining liquid in the liquid containing chamber 360.

Due to the surface layer 390 being formed on at least the incident surface 345*a* and the reflection surface 345*b*, which are the surfaces of the detection member 345, it is possible to suppress a case in which the liquid is attached or bubbles are attached to the incident surface 345*a* and the reflection surface 345*b*. Accordingly, it is possible to reduce the likelihood that the accuracy of detecting the amount of remaining liquid using the detection member 345 will decrease.

B-2. Second Modified Example

In the above-described embodiment, the surface layer 390 was formed on the entire surface of the inner surface 305*a* of the containing chamber forming wall 395, the entire surface of the outer surface 305*b* of the viewing wall 305, and the entire surface of the inner surface of the communication path forming wall 339, but the surface layer 390 may be formed on at least a portion of the surfaces. In this manner as well, it is possible to reduce the likelihood that the liquid will attach to and remain on the portion on which the surface layer 390 is formed, or it is possible to quickly eliminate bubbles if they are formed on the portion on which the surface layer 390 is formed. For example, the surface layer 390 may be formed on only the inner surface 305*a* of the viewing wall 305, may be formed on only the outer surface 305*b* of the viewing wall 305, and may be formed on only the inner surface of the communication path forming wall 339. Also, for example, the surface layer 390 may be formed on only the outer surface 305*b* of the viewing wall 305 and the inner surface 305*a* of the viewing wall 305. Due to the surface layer 390 being partially formed, it is possible to reduce the likelihood that the surface layer 390 of the defoaming agent or the water-repellent agent will have an adverse influence on the liquid.

B-3. Third Modified Example

In the above-described embodiment, the surface layer 390 may be formed on at least one of the upper limit indication portion 355 of the outer surface 305*b* of the viewing wall 305 and its surrounding region, and the upper limit indication portion 355 of the inner surface 305*a* of the viewing wall 305 and its surrounding region. In other words, "at least a portion of the viewing wall" according to the claims may be at least one of (i) the upper limit indication portion 355 of the outer surface 305*b* of the viewing wall 305 and its surrounding region, and (ii) the upper limit indication portion 355 of the inner surface 305*a* of the viewing wall 305 and its surrounding region. Also, the surface layer 390 may be formed on at least one of the lower limit indication portion 356 of the outer surface 305*b* of the viewing wall 305 and its surrounding region, and the lower limit indication portion 356 of the inner surface 305*a* of the viewing wall 305 and its surrounding region. In other words, "at least a portion of the viewing wall" according to the claims may be at least one of (i) the lower limit indication portion 356 of the outer surface 305*b* of the viewing wall 305 and its surrounding region, and (ii) the lower limit indication portion 356 of the inner surface 305*a* of the viewing wall 305 and its surrounding region.

B-4. Fourth Modified Example

In the above-described embodiment, a container that contains a liquid to be supplied to the liquid ejection apparatus was given as an example of the liquid container 300, but the invention may be applied to another container that contains ink, for example. For example, the surface layer 390 may be formed on the inner surface of a liquid container for injecting (replenishing) ink into the liquid container 300.

B-5. Fifth Modified Example

The invention is not limited to an ink jet printer and a liquid container for supplying ink to an ink jet printer, and can be applied to any liquid ejection apparatus that ejects a liquid other than ink and a liquid container for containing the liquid. For example, the invention can be applied to the following various liquid ejection apparatuses and their liquid containers.

(1) An image recording apparatus such as a facsimile apparatus (2) A color material ejection apparatus that is used to manufacture a color filter for an image display apparatus such as a liquid crystal display.

(3) An electrode material ejection apparatus that is used for electrode formation, such as an organic EL (Electro Luminescence) display or a field emission display (FED)

(4) A liquid ejection apparatus that ejects a liquid containing a biological organic substance to be used in biochip manufacturing (5) A specimen ejection apparatus serving as a precision pipette (6) An ejection apparatus for a lubricant (7) An ejection apparatus for a resin liquid (8) A liquid ejection apparatus that ejects a lubricant by pinpoint in a precise machine such as a watch or a camera (9) A liquid ejection apparatus that ejects a transparent resin liquid such as an ultraviolet-curable resin liquid onto a substrate in order to form a minute semi-spherical lens (optical lens) that is to be used as an optical communication element or the like

(10) A liquid ejection apparatus that ejects an acidic or alkaline etching solution in order to etch a substrate or the like

(11) A liquid ejection apparatus that includes a liquid ejection head for discharging any other droplet of a minute amount Note that the status of liquid discharged as very small droplets from the liquid ejection device includes a granular shape, a tear-drop shape, and a shape having a thread-like trailing end. Furthermore, the liquid mentioned here may be any kind of material that can be consumed by the liquid ejection device. For example, the liquid need only be a material whose substance is in the liquid phase, and includes fluids such as inorganic solvent, organic solvent, solution, liquid resin, and liquid metal (metal melt) in the form of a liquid body having a high or low viscosity, sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiment, as well as liquid crystal, and the like. Here, "ink" encompasses general water-based ink and oil-based ink, as well as various types of liquid compositions such as gel ink and hot melt-ink.

The invention is not limited to the above-described embodiments, working examples, and modified examples, and can be realized with various configurations without departing from the gist thereof. For example, the technical features in the embodiments, working examples, and modified examples that correspond to the technical features in the various modes described in the summary of the invention can be replaced or combined as appropriate in order to solve a portion or all of the above-described problems or in order to achieve a portion or all of the above-described effects. Also, if a technical feature has not been described as being essential in the present specification, it can be omitted as appropriate.

What is claimed is:

1. A method for manufacturing a liquid container for containing a liquid, comprising:

providing a pre-formation liquid container comprising a plurality of walls defining a liquid containing chamber configured to contain the liquid, the plurality of walls including a viewing wall through which the liquid contained in the liquid containing chamber is viewable from an exterior of the pre-formation liquid container;

providing an aqueous solution comprising (i) water, and (ii) a defoaming or water-repellent agent, wherein the defoaming or water-repellant agent is a silicone-based surfactant containing siloxane;

bringing the aqueous solution into contact with a contact portion that includes at least a surface of the viewing wall of the pre-formation liquid container, wherein the contact portion comprises a hydrophobic material, such that the defoaming or water-repellant agent is fixed to the contact portion by hydrophobic adsorption; and drying the contact portion that includes the surface of the viewing wall to form a surface layer comprising the defoaming or water-repellent agent on at least the surface of the viewing wall.

2. The method for manufacturing a liquid container according to claim 1, wherein:

the plurality of walls further includes an additional wall other than the viewing wall, and the contact portion includes at least a portion of a surface of the additional wall.

3. The method for manufacturing a liquid container according to claim 2, wherein:

the liquid container further comprises a liquid inlet portion through which the liquid is injectable into the liquid containing chamber.

4. The method for manufacturing a liquid container according to claim 2, wherein:

the pre-formation liquid container further comprises a communication path forming wall defining an atmosphere communication path that causes the liquid containing chamber to be in communication with atmosphere, and the contact portion includes at least a portion of an inner surface of the communication path forming wall.

5. The method for manufacturing a liquid container according to claim 1, wherein:

the pre-formation liquid container further comprises a prism, and the contact portion includes a surface of the prism.

6. The method for manufacturing a liquid container according to claim 1, wherein:

the contact portion includes an inner surface of the viewing wall.

7. The method for manufacturing a liquid container according to claim 1, wherein:

the contact portion includes an outer surface of the viewing wall.

8. The method for manufacturing a liquid container according to claim 1, wherein:

in the step of drying the contact portion, the contact portion is dried without a heat treatment.

9. The method for manufacturing a liquid container according to claim 1, wherein:

the aqueous solution is substantially free of alcohol.

10. A liquid container for containing a liquid, comprising:

a plurality of walls defining a liquid containing chamber configured to contain the liquid, the plurality of walls including a viewing wall through which the liquid contained in the liquid containing chamber is viewable from an exterior of the liquid container; and a surface layer comprising a defoaming or water-repellant agent, wherein the defoaming or water-repellant agent is a silicone-based surfactant containing siloxane, wherein the surface layer is formed on a contact portion that includes at least a surface of the viewing wall, and wherein the contact portion comprises a hydrophobic material.

11. The liquid container according to claim 10, wherein:

the plurality of walls further includes an additional wall other than the viewing wall, and the contact portion includes at least a portion of a surface of the additional wall.

12. The liquid container according to claim 11, further comprising:

a liquid inlet portion through which the liquid is injectable into the liquid containing chamber.

13. The liquid container according to claim 11, further comprising:

a communication path forming wall defining an atmosphere communication path that causes the liquid containing chamber to be in communication with atmosphere, wherein the contact portion includes at least a portion of an inner surface of the communication path forming wall.

14. The liquid container according to claim 10, further comprising:

a prism, wherein the contact portion includes a surface of the prism.

15. The liquid container according to claim 10, wherein:

the contact portion includes an inner surface of the viewing wall.

16. The liquid container according to claim 10, wherein:

the contact portion includes an outer surface of the viewing wall.

* * * * *